US005467542A

United States Patent [19]

Hulden

[11] Patent Number: 5,467,542

[45] Date of Patent: Nov. 21, 1995

[54] COUPLING ASSEMBLY AND ACTUATING MECHANISM THEREFOR

[76] Inventor: Fritiof Hulden, Laskeruds Gardi, S-660 60 Molkom, Sweden

[21] Appl. No.: 294,310

[22] Filed: Aug. 23, 1994

[51] Int. Cl.[6] ..... E02F 3/28

[52] U.S. Cl. ..... 37/468; 37/906; 414/723; 172/272

[58] Field of Search ..... 414/723; 37/906, 37/468; 172/272; 403/381, 322

[56] References Cited

U.S. PATENT DOCUMENTS

| | | | |
|---|---|---|---|
| 4,663,866 | 5/1987 | Karlsson et al. | 37/468 |
| 4,944,628 | 7/1990 | Huldén | 403/322 |
| 5,010,962 | 4/1991 | Blsom, Jr. | 414/723 |
| 5,400,531 | 3/1995 | Brown | 37/468 |

*Primary Examiner*—David H. Corbin
*Assistant Examiner*—Spencer Warnick
*Attorney, Agent, or Firm*—Lalos & Keegan

[57] ABSTRACT

An assembly for coupling a maneuvering member to a working implement generally consisting of a first coupling component mountable on the working tool, a second coupling component mountable on the maneuvering member and cooperative with the first coupling component for selectively coupling the coupling components together, the first coupling component having an annular undercut portion providing an outwardly facing, beveled gripping surface, the second coupling component having a fixed gripping member and a moveable gripping member displaced relative to the fixed gripping member along a line of travel, the gripping members having arcuate undercut portions providing inwardly facing, beveled gripping surfaces engageable with the outwardly facing, beveled gripping surface of the second coupling component, means for selectively displacing the moveable gripping member relative to the fixed gripping member along the line of travel into a fully coupled condition of the coupling components and a fully uncoupled condition of the coupling components, latch means for restricting the displacement of the moveable gripping member relative to the fixed gripping member into a partially uncoupled condition insufficient to permit removal of said second coupling component from the first coupling component yet sufficient to permit a rotational displacement of the coupling members relative to each other and means for selectively displacing the latch means.

26 Claims, 4 Drawing Sheets

COUPLING ASSEMBLY AND ACTUATING MECHANISM THEREFOR

BACKGROUND OF THE INVENTION

This invention relates to an improved assembly for coupling a working implement such as a bucket, grapple, rake or the like to a maneuvering member such as the operating arm of an excavator machine or the like, which is operable to readily attach or detach the working implement to and from the maneuvering member and to angularly reorient the working implement relative to the maneuvering member. The invention further contemplates a novel actuating mechanism for such an assembly.

In my previously issued U.S. Pat. No. 4,944,628 dated Jul. 31, 1990, there is disclosed an assembly for quickly attaching and detaching a working implement to and from the operating arm of an excavator machine. Generally, the assembly consists of a first coupling component mounted on the working implement and a second coupling component mountable on the maneuvering member and cooperable with the first coupling component to attach the working implement to the maneuvering member. The first coupling component includes an annular undercut portion providing a beveled gripping surface, and the second coupling component includes a pair of gripping members displaceable relative to each other, having arcuate, beveled gripping surfaces engageable with the beveled gripping surface of the first coupling component to firmly attach the working implement to the maneuvering member.

In one embodiment of the coupling assembly disclosed in my previous patent, the beveled gripping surface of the first coupling component faces inwardly and the beveled gripping surfaces of the second coupling component face outwardly so that when the engageable gripping surfaces are aligned and the gripping members of the second coupling component are fully extended or retracted, the coupling components are respectively firmly coupled together and freely uncoupled. In another embodiment of such assembly, the annular, beveled gripping surface of the first coupling component faces outwardly and the arcuate, beveled gripping surfaces of the gripping members of the second coupling component face inwardly so that when the gripping surfaces are aligned and the gripping members are fully extended and fully retracted, the gripping surfaces will fully engage and fully disengage to couple and uncouple the coupling components, respectively.

In either of the aforementioned embodiments, it is contemplated that the gripping members will be displaced into an intermediate position in which the coupling components are neither firmly coupled or fully uncoupled to permit the angular reorientation of the working implement relative to the maneuvering member. The positioning of the gripper members in such an intermediate position, however, primarily has been accomplished through the judgment and skill of the operator of the machine thus resulting in a possible error in judgment as to whether the coupling components are in the partially uncoupled or fully uncoupled condition which further could result in an accident. It thus has been found to be desirable to provide an improved coupler assembly of the type described in which the operator's judgment and skill is not relied upon in determining whether the coupling components are in their partially uncoupled or fully uncoupled condition.

Accordingly, the principal object of the present invention is to provide an improved assembly for coupling a working implement such as a bucket, grapple, rake and the like to a maneuvering or manipulator member such as the operating arm of an excavator machine.

Another object of the present invention is to provide an improved assembly for coupling a working implement to a maneuvering member in which the working implement may be angularly reoriented relative to the maneuvering member.

A further object of the present invention is to provide an improved assembly for coupling a working implement to a maneuvering member having an improved actuating mechanism.

A still further object of the present invention is to provide an improved assembly for coupling a working implement to a maneuvering member in which one of the coupling components includes a pair of gripping members adapted to be disposed in fully coupling, loosely coupling and fully uncoupling positions.

Another object of the present invention is to provide an improved assembly for coupling a working implement to a maneuvering member in which one of the coupling components includes a pair of gripping members adapted to be disposed in a fully coupling, a loosely coupling and a fully uncoupling position, and in which an operator of the maneuvering member can be clearly apprised of the uncoupled condition of the assembly.

A further object of the present invention is to provide an improved assembly for coupling a working implement to a maneuvering member which is relatively simple in design, comparatively inexpensive to manufacture and highly effective in performance.

Other objects and advantages of the present invention will become more apparent to a person having ordinary skill in the art to which the present invention pertains from the following description taken in conjunction with the accompanying drawings in which:

BRIEF DESCRIPTION OF THE DRAWINGS

Referring to FIG. 1 there is shown an excavator machine 10, a bucket 11 and an assembly 12 for detachably coupling the bucket to the excavating machine. The machine is provided with a conventional boom 13, an operating arm member 14 pivotally connected to the free end of the boom, a hydraulic cylinder assembly 15 operatively interconnecting a base portion of the machine and an intermediate portion of the boom for pivoting the boom and a hydraulically actuated cylinder assembly 16 operatively interconnecting a mid portion of the boom and a free end of the operating arm. The opposite end of the operating arm is provided with a pair of links 17 and 18 pivotally connected to the operating arm and a link 19 pivotally connected at one end to the free ends of links 17 and 18 by means of a pin 20 and pivotally connected at the opposite end to the coupler assembly by means of a pin 21. The bucket is caused to be pivoted relative to the operating arm by means of a hydraulically actuated cylinder assembly 22 operatively interconnecting an upper end of the operating arm and connecting pin 20. It will be appreciated that by operating cylinder assemblies 15, 16 and 22 by means of controls provided in the cab of the machine, bucket 11 or any other working implement such as a grapple, rake, stump splitter, rock crusher, jackhammer and the like may be manipulated to perform various work functions including excavating, raking, clearing, splitting, crushing, breaking and the like, in the conventional manner.

Figure 1:
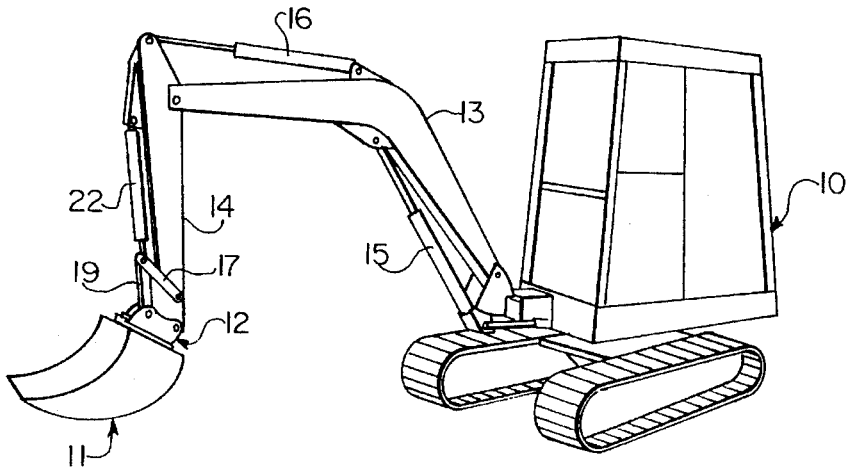
FIG. 1 is a perspective view of an excavator machine provided with a working implement coupled to the operating arm of the machine by means of an assembly embodying the present invention.

As best illustrated in FIGS. 2 through 8, coupling assembly 12 consists of a coupling component 23 adapted to be mounted on a working implement such as bucket 11 and a coupler component 24 adapted to be connected to a manipulating member such as operating arm 14 and cooperable with coupling component 23 to selectively attach and detach the working implement to and from the manipulating member. Coupling component 23 is comparatively simple in design, consisting of a flat steel plate welded to the top wall 25 of the working implement and having an annular undercut portion 26 providing an outwardly facing, annular beveled gripping surface 27. Preferably, coupling component 23 is rigidly mounted on an upper surface of the working implement to facilitate access of coupling component 24 for attaching and detaching the working implement to and from the operating arm of the machine and angularly reorienting the working implement about the axis of annular beveled gripping surface 27 as will later be described.

Coupling component 24 is best shown in FIGS. 3 through 8 and generally consists of a fixed gripping member 28 detachably connectable to operating arm 14 for pivotal movement relative thereto about a connecting pin 35, and a moveable gripping member 29 mounted on the fixed gripping member and displaceable relative thereto along a line of travel coinciding substantially with a longitudinal centerline of the fixed gripping member.

Fixed gripping member 28 includes a top wall 30 a bottom wall 31 a pair of side walls 32 and 33 and a rear wall 33. Side walls 32 and 33 project upwardly from top wall 30 and are provided with transversely aligned openings for receiving pin 35 for pivotally connecting coupler member 24 to operating arm 14 and pin 21 for connecting the forward end of the component to link 19. By operating hydraulic cylinder 22, it will be appreciated that the coupling assembly and attached working implement will be caused to pivot about the axis of connecting pin 35.

Bottom wall 31 of the fixed gripping member is provided with a rearwardly disposed, depending portion 36 having a forwardly facing, arcuate undercut portion 37. The undercut portion further is provided with an arcuate, beveled gripping surface 38 adapted to engage annular, beveled gripping surface 27 of coupling component 23 when the coupling assembly is in the coupled condition. Beveled gripping surface 38 is provided with the same pitch and radius of curvature as annular gripping surface 27 so that when gripping surface 38 of coupling component 24 engages the annular, beveled gripping surface 27 of coupling component 23, such surfaces will engage completely and firmly.

Moveable gripping member 29 includes an elongated main body portion 39, a forwardly disposed, depending portion 40 and rearwardly disposed, rearwardly extending arm portions 41 and 42. Main body portion 39 is disposed along the longitudinal centerline of the fixed gripping member, and is adapted to be displaced longitudinally between the upper and lower walls of the fixed gripping member. A pair of transversely spaced side wall members may be provided between the upper and lower walls of the fixed gripping member to provide a guide channel for the longitudinal displacement of the main body portion of the moveable gripping member. The longitudinal displacement of the moveable gripping member further is guided by means of rearwardly projecting arm portions 41 and 42 which straddle a vertically disposed tubular member 43 disposed on the centerline of the fixed gripping member and secured to the lower wall thereof.

Rearwardly extending arm portions 41 and 42 further are provided with a pair of laterally projecting wing portions 44 and 45 which are disposed between the upper and lower walls of the fixed gripping member and extend toward side walls 32 and 33. The moveable gripping member is displaced along the longitudinal center line of the fixed gripping member by means of a pair of hydraulically actuated cylinder assemblies 46 and 47, the axes of which are disposed laterally and parallel to the longitudinal centerline of the fixed gripping member. Cylinder assembly 46 includes a cylinder member **46*a* having an end bracket secured to a pin disposed between the upper and lower walls of coupling member 28 and a rod portion 46*b* having the end thereof rigidly secured within wing portion 44 of the moveable gripper member. Similarly, cylinder assembly 47 includes a cylinder member 47*a* provided with a bracket mounted on a pin secured to the upper and lower walls of gripper member 28, and a rod member 47*b* having the end thereof secured to wing portion 45 of gripper member 29**.

Figure 4:
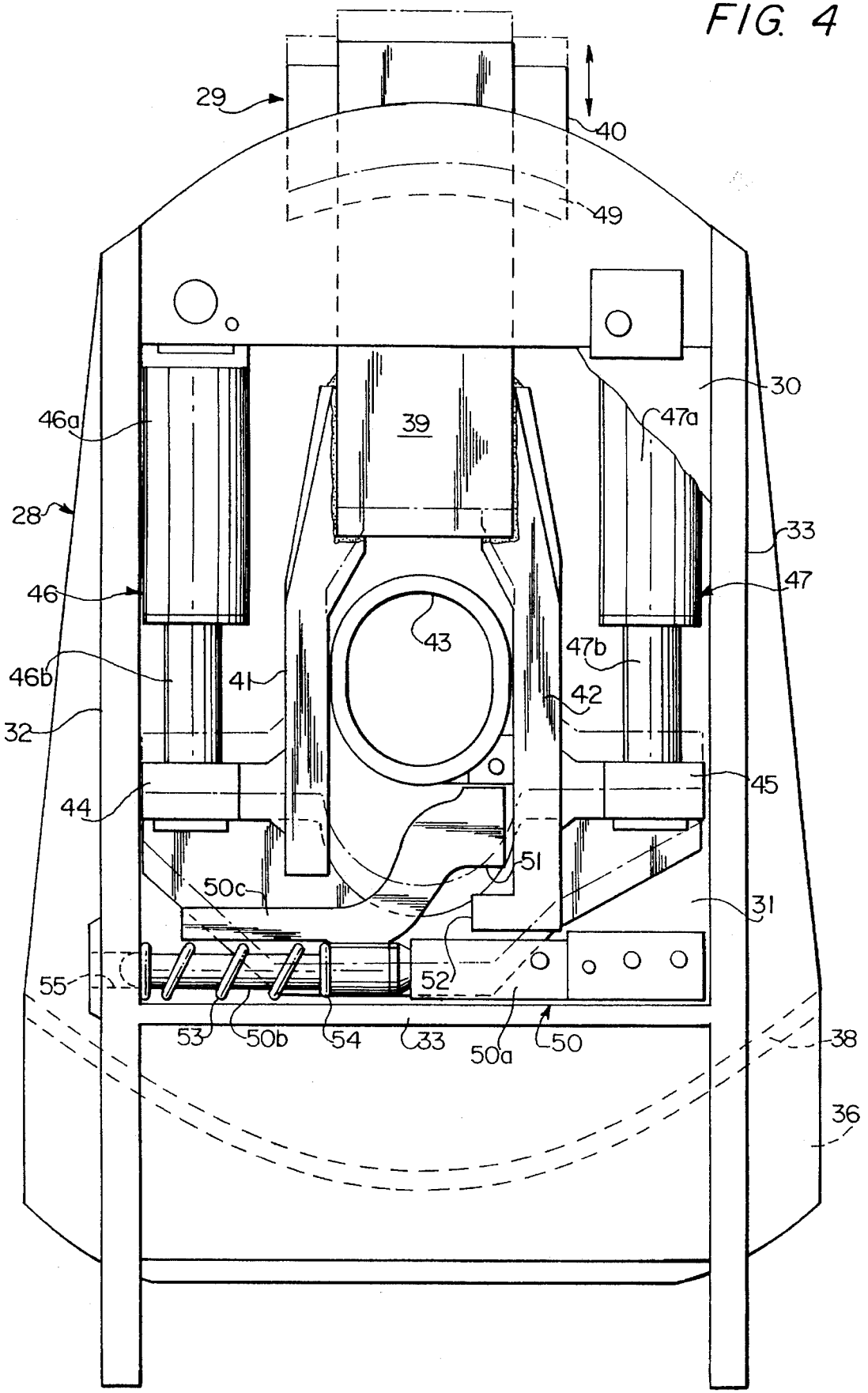
FIG. 4 is an enlarged, top plan view of a component of the coupling assembly shown in FIGS. 1 and 3, having a cover portion removed and illustrating the component in a fully coupling condition.
Figure 8:
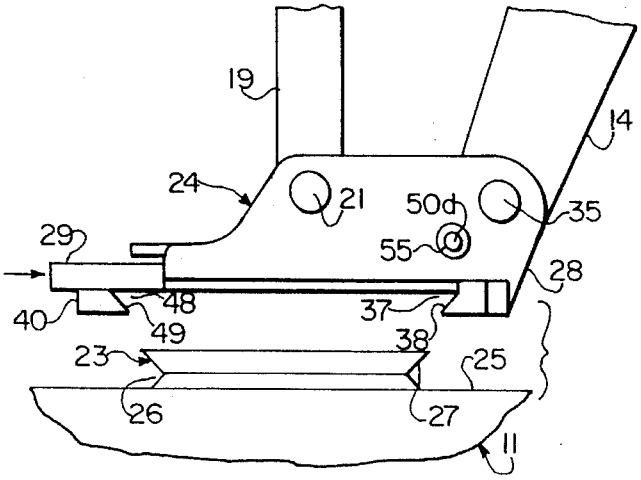
FIG. 8 is a view similar to the view shown in FIGS. 6 and 7, illustrating the assembly in the uncoupled condition.

As best shown in FIGS. 4 and 8, depending portion 40 of the moveable gripping member is provided with an arcuate, undercut portion 48 having an arcuate, rearwardly facing beveled surface 49. Arcuate, beveled gripping surface 49 is disposed in opposed relation to arcuate, beveled gripping surface 38 of the fixed gripping member and is provided with the same pitch and radius of curvature as gripping surfaces 38 and 27 so that when the coupling components are in the condition as shown in FIG. 6, gripping surfaces 49, 38 and 27 will be fully and firmly engaged in positive gripping relation.

Figure 6:
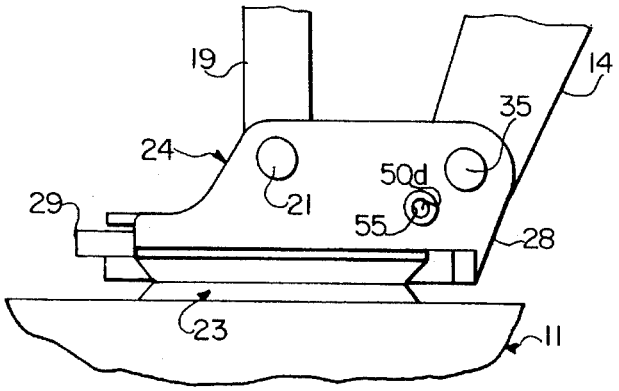
FIG. 6 is an enlarged, side view of the coupling assembly shown in FIGS. 1 and 3, illustrating the assembly in the fully coupled condition.

It will be appreciated that by aligning gripping surfaces 49 and 38 of the moveable and fixed gripping members of coupling component 24 with gripping surface 27 of coupling component 23, and causing the rod members of cylinder assemblies 46 and 47 to extend, the coupling components will be disposed in a coupled condition as shown in FIG. 6. Upon fully retracting the rod members to disengage the gripping members of coupling component 24 from coupling component 23, coupling component 24 is freed to be detached from coupling component 23, as shown in FIG. 8. If it is desired, however, to disengage the coupling members only a small amount for the purpose of angularly reorienting the operating arm relative to the working implement, the rod members of the cylinder assemblies must be retracted only a small amount, sufficient to disengage the gripping surfaces yet insufficient to fully withdraw the protruding portions of the moveable and fixed gripping members from the undercut portion of coupling component 23.

Figure 5:
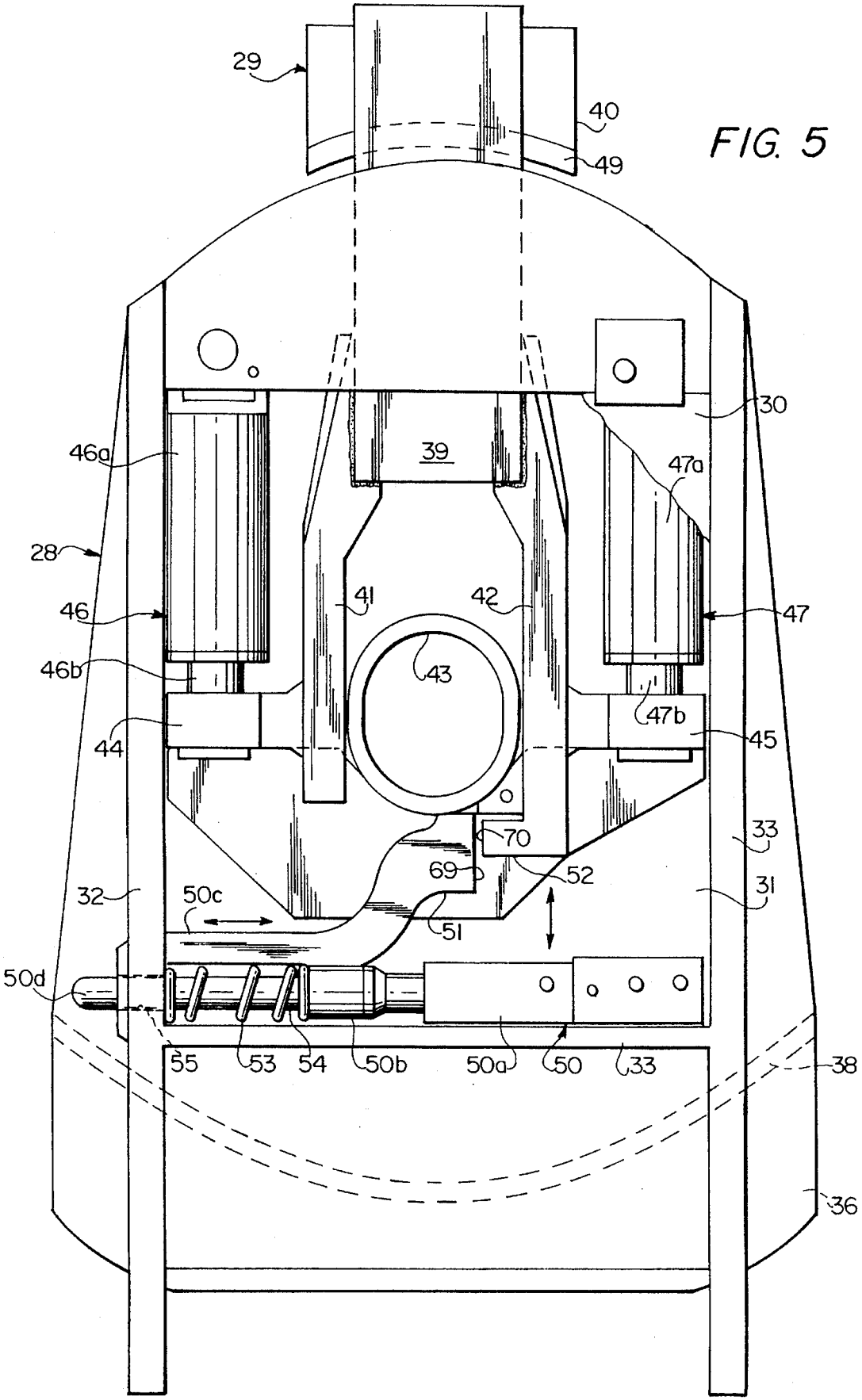
FIG. 5 is a view similar to the view shown in FIG. 4, illustrating the component in a fully uncoupling condition.

In the prior art, the operation of cylinders comparable to cylinder assemblies 46 and 47 to disengage the gripping surfaces yet allow the coupling components to remain attached was left to the judgment and skill of the operator. Such arrangement, however, ran the risk of unintended detachment of the coupling components, possibly causing damage to property or injury to personnel in the area of the working implement. In the present invention, such operation is not left to the judgment and skill of the operator but is attended to by the construction of the actuating mechanism of the coupling assembly. There is provided an arrangement whereby the rod members of cylinder assemblies 46 and 47 are permitted to retract only a limited amount to permit the gripping surfaces to disengage yet prevent the coupling members from becoming fully detached. Such arrangement consists of a hydraulically operated latch mechanism 50 provided on fixed gripping member 28 which cooperates with moveable gripping member 29, as best illustrated in FIGS. 4 and 5. The latch mechanism is disposed transversely and mounted in the rear end of the fixed gripping member and includes a cylinder member 50*a* a rod member 50*b* and a latch arm 50*c*. With rod member 50*b* in a retracted position as shown in FIG. 4, latch arm 50*c* will be positioned with a transversely disposed abutment surface 51 disposed in the path of movement of a lug portion 52 of rearwardly projecting portion 42 of the moveable gripping member so that upon actuation of cylinders 46 and 47, the outward displacement of the moveable gripping member relative to the fixed gripping member will be obstructed by the engagement of lug portion 52 with abutment surface 51. The amount of displacement of the moveable gripping member relative to the fixed gripping member upon engagement of lug portion 52 with abutment surface 51 corresponds to the amount of displacement required to disengage the gripping surfaces of the coupling components yet insufficient to fully detach the components. Under such conditions, the working implement can be angularly oriented relative to the operating arm of the machine.

Under normal conditions, rod member 50*b* is yieldingly biased into a retracted position by means of a coil spring 53 disposed between side wall 32 and a collar 54 provided on the rod member 50*b*. When it is desired to fully detach coupling component 24 from coupling component 23 as shown in FIG. 8, fluid under pressure is supplied to the piston end of single-acting cylinder member 50*a* to extend rod member 50*b* against the biasing action of spring 53 to correspondingly shift latch arm 50*c* laterally thus removing abutment surface 51 from the travel path of lug portion 52, allowing the moveable gripper member to fully displace relative to the fixed gripper member as shown in FIG. 5. Under such conditions, the end portion of rod member 50*b* will be caused to protrude through an opening 55 in side wall 32 which would be observed by the operator of the machine as an indication that the components of the coupling assembly were fully detached. When fluid pressure is removed from single-acting cylinder 50*a* and the components of the coupling assembly remain in the uncoupled position, the rod member of the latch mechanism will remain in the extended position with the end portion protruding beyond side wall 32 as a result of the engagement of latch member 50*c* with the end portion of lug portion 52 as shown in FIG. 5. Upon extension of rod members 46*b* and 47*b* of cylinder assemblies 46 and 47, lug portion 52 of the moveable gripper member will be displaced rearwardly beyond the engaging face of latch arm 50*c* to free the latch arm and allow rod member 50*b* to retract under the action of spring 53.

Figure 9:
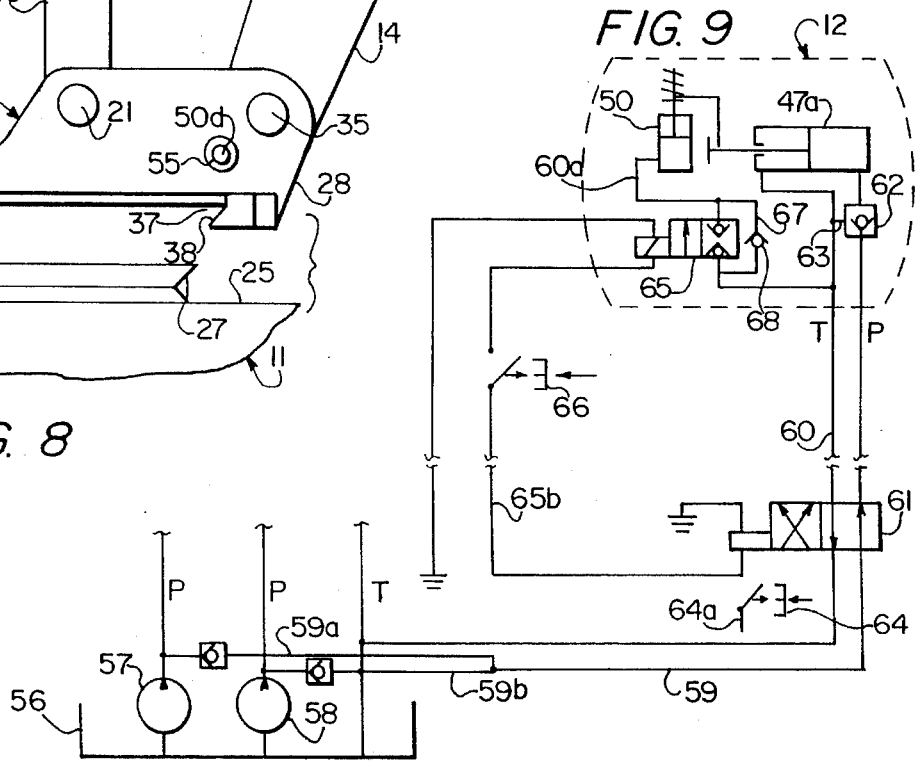
FIG. 9 is a schematic-diagrammatic view of the hydraulic control system for the coupling assembly shown in FIGS. 1 through 8.

FIG. 9 illustrates the control system for the coupling assembly 12. The system includes an oil tank 56, a set of pumps 57 and 58, a fluid pressure line 59 operatively interconnecting the piston ends of cylinder members 46*a* and 47*a* through a set of branch lines, and the pressure ends of fluid pumps 57 and 58 through branch lines 59*a* and 59*b* and a fluid return line 60 operatively interconnecting the rod ends of cylinder members 46*a* and 47*a* through a set of branch lines and tank. Provided in fluid lines 59 and 60 is an electrically operated solenoid selector valve 61 and a pilot check valve 62. Selector valve 61 normally is in the position as shown in FIG. 9, supplying fluid under pressure through check valve 62 to the piston ends of cylinder members 46*a* and 47*a* to maintain cylinder assemblies 46 and 47 extended and the gripping members in a fully retracted condition. Selector valve 61 may be energized to supply fluid under pressure to the rod ends of cylinder members 46*a* and 47*a* by depressing a button 64 located at the operator's station on the machine to close a set of contacts in line 64*a* to energize the coil of the valve. Check valve 62 functions to maintain rod portions 46*b* and 47*b* fully extended and further functions to open upon sensing a predetermined pressure in the piston ends of cylinder members 46*a* and 47*a* by means of a pilot line 63 communicating with fluid line 60.

Valve 65 is energized by a branch line 65*b* connected to line 64*a* on the solenoid side of button operated switch 64, which is provided with a button operated switch 66. Preferably, button operated switches 64 and 66 are located on the operator's control console in the cab of the machine with a hinged cover on the button of switch 66 to prevent its unintended depression. Normally, the operator would be depressing only the button of switch 64 to partially release the implement in order to reorient the implement. When it is desired to fully release the implement, the operator would be required to depress the button for switch 64, remove the cover for the button of switch 66 and then depress the uncovered button. Valve 65 also is provided with a bypass line 67 provided with a check valve 68.

Figure 2:
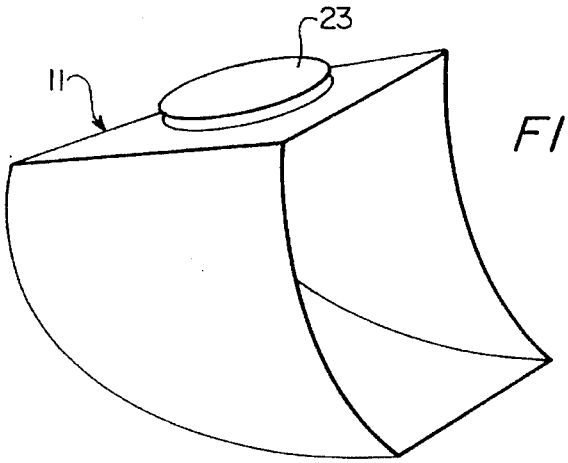
FIG. 2 is an enlarged perspective view of the working implement shown in FIG. 1, provided with a component of the coupling assembly shown in FIG. 1.

In the embodiment of the invention as described, with the working implement positioned as shown in FIG. 2 and cylinder assemblies 46 and 47 positioned as shown in FIG. 5 with the gripping members fully extended apart, the operating arm of the excavator machine is maneuvered to position coupling component 24 atop coupling component 23 with opposed gripping surfaces 49 and 38 of the gripping members being aligned horizontally with annular gripping surface 27 of coupling component 23. The operating arm further may be maneuvered to provide the desired angular relationship between the coupling components and correspondingly between the working implement and the operating arm. With the working implement thus positioned, control valve 61 is positioned as shown in FIG. 9 to supply fluid under pressure to the piston ends of cylinder members 46*a* and 47*a* to extend the rod members thereof to the positions as disclosed in FIG. 4. As the rod portions of the cylinder assemblies extend, the gripping members of coupling component 24 will be displaced toward each other so that gripping surfaces 49 and 38 of component 24 engage gripping surface 27 of component 23 in firm gripping relation, as illustrated in FIG. 6. The working implement will then be firmly attached to the operating arm to permit the implement to be maneuvered to perform various work functions such as excavating and the like.

As the rod members of cylinder assemblies 46 and 47 extend to displace the gripping members toward each other, lug portion 52 of gripping member 29 is caused to displace rearwardly past abutment surface 51 of latch arm 50*c*. Under such circumstances, the action of coil spring 53 will cause rod member 50*b* to retract causing arm member 50*c* to assume a latched position as shown in FIG. 4. Oil in the piston end of cylinder member 50*a* will be returned to tank through lines 64, 67 and 60.

Prior to the actuation of cylinder assemblies 46 and 47 as shown in FIG. 5, the retraction of rod member 50*b* of the latching mechanism would be prevented under the biasing action of coil spring 53 by reason of the engagement of end surface 69 of latch arm 50*c* with an end surface 70 of lug portion 52. Under such conditions, the end portion 50*d* of rod member 50*b* will extend through opening 55 in side wall 32 to provide a visual indication to the operator of the machine that the gripping members of coupling component 24 are in their fully extended positions. As the gripping members are displaced toward each other, lug portion 52 will slide along end surface 69 of latch arm 50*c* until it clears the end of the latch arm, allowing latch arm 50*c* to displace to the right relative to FIGS. 4 and 5 to a position as shown in FIG. 4. Under such conditions, end portion 50*d* of rod member 50*b* would be fully retracted within coupling component 24 and remain out of view of the operator indicating that gripper member 29 is in its fully retracted position and that the coupling components are in their fully coupled position. In addition, the control system of the coupling assembly will be in the condition as shown in FIG. 9.

Figure 3:
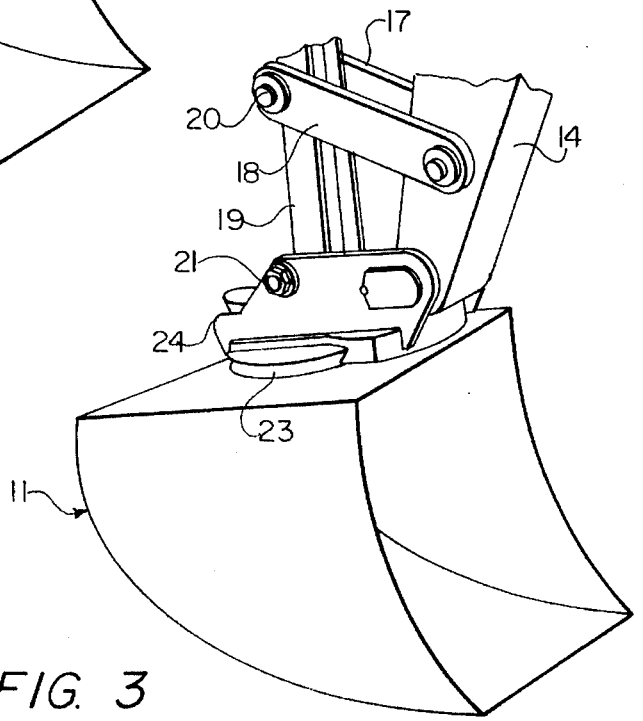
FIG. 3 is an enlarged, fragmentary view of the working implement, operating arm and coupling assembly shown in FIG. 1, in which the working implement is shown having been reoriented 180° from the position shown in FIG. 1.
Figure 7:
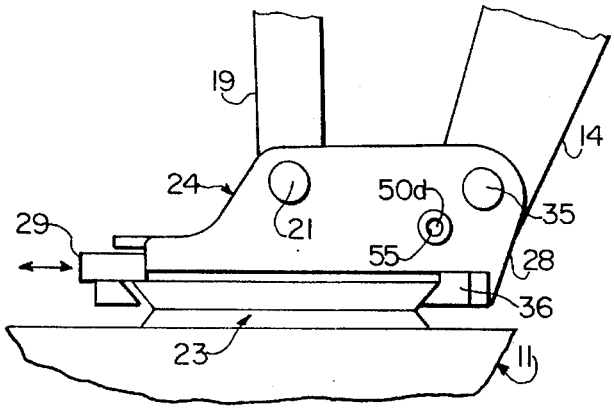
FIG. 7 is a view similar to the view shown in FIG. 6, illustrating the assembly in the partially coupled condition.

Whenever it may be desired to adjust the angular relationship of the working implement relative to the operating arm such as reorienting the angular position of the working implement from the position shown in FIG. 1 to the position shown in FIG. 3, the operating arm first is maneuvered to position the working implement on the ground. Button 64 is then depressed by the operator to energize valve 61 and cause it to displace to the right relative to FIG. 9 to supply fluid under pressure to the rod sides of cylinder members 46*a* and 47*b*. Under such conditions, the rod members of cylinder assemblies 46 and 47 will retract but their displacement will be restricted by the engagement of lug portion 52 of gripping member 29 with abutment surface 51 of latch arm 50*c*. The effect of such restriction would be to extend gripping member 29 sufficiently to disengage gripping surfaces 49 and 38 from gripping surface 27 of coupling component 29 yet insufficiently to fully release coupling member 23 from coupling component 24, as shown in FIG. 7. Under such conditions, the working implement and operating arm of the machine are free to be angularly adjusted relative to each other about the axis of gripping surface 27 of coupling component 23 but not free to be totally detached from each other. If the operating arm were inadvertently moved under such conditions, it would loosely carry the working implement with it. The operator would be informed of such condition of the coupling assembly by reason of the fact that the end portion of rod member 50*b* would not be protruding through side wall 53 and visible to him.

When it then is desired to recouple the assembly, control valve 61 is operated to be positioned as shown in FIG. 9 so that a supply of fluid under pressure is provided to the piston ends of cylinder members 46*a* and 47*b* to fully extend the rod portions thereof and cause the gripping members again to firmly grip coupling component 23. The working implement would then again be firmly secured to the operating arm to perform additional work functions.

Whenever it might be desired to fully detach the working implement from the operating arm, the operating arm again is maneuvered to position the working implement on the ground. Buttons are then depressed by the operator to close switches 64 and 66 to energize and thus displace control valves 61 and 65 to the right relative to FIG. 9. Under such conditions, fluid under pressure is supplied through lines 59, 60, 64 and open valve 65 to the piston end of cylinder 50*a* to displace latch member 50*c* to the left relative to FIGS. 4 and 5 thus freeing gripping member 29 to be fully extended, and fluid under pressure simultaneously is applied to the piston ends of cylinder members 46*a* and 47*b* to retract the rod members thereof and fully extend gripper member 29. Coupler component 24 then would be fully detached from coupler component 23 to permit its removal as shown in FIG. 8. As such operation occurs, the end portion of rod member 50*b* will protrude beyond wall 32 of coupler component 24 as shown in FIG. 5 to indicate to the operator that the coupler components are in their fully detached conditions.

Although the embodiment of the invention disclosed in FIGS. 1 through 8 provides for one of the coupling components having a fixed gripping member adapted to be connected to the operating arm and a moveable gripping member adapted to be displaced relative to the fixed gripping member, it is within the contemplation of the invention to provide for one of the coupling components having a base member adapted to be operatively connected to the operating arm and two moveable gripping members mounted on the base member and being displaceable relative to each other to provide the required gripping action. In such an embodiment, the arrangement of the cylinder assemblies for displacing the gripping members relative to each other would be modified from the arrangement as shown in the drawings. Such cylinder assemblies could operatively interconnect the displaceable gripping members and other arrangements could be used. In any of such arrangements, a latching mechanism of the type described would be utilized for preventing the complete detachment of the coupling components to permit the angular reorientation of the working implement relative to the operating arm as previously described.

In addition, the configurations of the mating portions of the coupler components can be varied within the scope of the invention. In particular, the undercut portion of the coupling component secured to the working implement may be provided with an inwardly facing annular gripping surface as opposed to an outwardly facing annular gripping surface as provided in the embodiment shown in FIGS. 1 through 8, and the undercut portions of the gripping members of the other coupling component would be formed with outwardly facing gripping surfaces that would mate with the annular, inwardly facing gripping surface of the other coupling component. In such an arrangement, the gripping members would have to be retracted to permit the portion of the coupler component providing the gripping members to be inserted within the opening provided in the other coupling component so that when the gripping surfaces of the two components are in horizontal alignment, the gripping members may be displaced apart to provide engagement of the gripping surfaces in gripping relation. Furthermore, although the embodiment described provides for the mating gripping surfaces to be beveled, such surfaces need not be beveled although beveled gripping surfaces are preferable to remedy any misalignment of the gripping surfaces and provide a firmer gripping action.

The invention as described is intended to be used with any type of working implement normally used for ground working and other functions. Although the embodiment of the invention described utilizes a bucket of a particular configuration for excavating purposes, buckets of other configurations and for other purposes may be used along with other working implements such as grapples, rakes, stump splitters, jackhammers, rock crushers, shear blades and the like.

The actuating mechanism for the gripping members of the coupler assembly and the control circuit for operating the actuating mechanism permits not only the quick attachment and detachment of the working implement, a quick change from one type of working implement to another type and a quick and easy reorientation of the working implement relative to the operating arm of the machine but also for an automatic partial detachment of the coupler components not requiring the judgment and skill of the operator. It further provides for a visual indication of the existence of the uncoupled condition of the coupling assembly thus providing an important safety feature in the use of the invention. By providing a latch mechanism of the type described, the operator is able to determine when the coupler components are uncoupled. Otherwise, the operator might attempt to reorient the working tool with the coupling members detached which not only would make the task more difficult if not impossible but also could result in a movement of the working implement possibly causing damage to property or injury to personnel in the vicinity of the working implement.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly for coupling a maneuvering member to a working implement comprising:

a first coupling component mountable on said working implement;

a second coupling component mountable on said maneuvering member and cooperative with said first coupling component for selectively coupling said first coupling component to said second coupling component;

said first coupling component having an annular undercut portion and a gripping surface;

said second coupling component having first and second gripping members, each provided with a protruding portion receivable within said annular undercut portion and a gripping surface engageable with the gripping surface of said first coupling component in gripping relation therewith when said gripping members are displaced relative to each other along a line of travel;

means for selectively displacing said gripping members relative to each other along said line of travel into a fully coupled condition of said coupling components wherein the protruding portions of said gripper members are received within said annular undercut portion of said first coupling component and the gripping surfaces of said gripping members firmly engage the gripping surface of said first coupling component, and into a fully uncoupled condition of said coupling components wherein the protruding portions of said gripper members are disposed without said annular undercut portion of said first coupling component;

means for restricting the displacement of said gripping members into a partially uncoupled condition between said fully coupled and fully uncoupled conditions and sufficient to disengage said gripping surfaces to allow rotational displacement of one coupling component relative to the other coupling component about the axis of said annular undercut portion, for reorientating said working tool relative to said maneuvering member; and means for selectively disabling said restricting means.

2. An assembly according to claim 1 wherein said first coupling component is rigidly secured to said working implement.

3. An assembly according to claim 1 wherein said second coupling component is detachably connected to said maneuvering member.

4. An assembly according to claim 1 wherein said working implement is an implement selected from a group of implements consisting of a bucket, grapple, stump splitter, rake, rock crusher and jackhammer.

5. An assembly according to claim 1 wherein said first coupling component is formed with a beveled side surface providing said annular undercut portion and said gripping surface thereof, and wherein said gripping members are formed with arcuate, beveled side surfaces providing said protruding portions and gripping surfaces thereof.

6. An assembly according to claim 5 wherein said annular undercut portion of said first coupling member opens outwardly and said gripping surface thereof faces outwardly, and said protruding portions of said second coupling component protrude inwardly and said gripping surfaces thereof face inwardly in opposed relation.

7. An assembly according to claim 1 wherein one of said gripping members of said second coupling component is mountable on said maneuvering member and the other of said gripping members is displaceable relative to the one gripping member.

8. An assembly according to claim 1 wherein said means for selectively displacing said gripper members relative to each other comprises at least one fluid actuated cylinder assembly operatively interconnecting said gripper members.

9. An assembly according to claim 8 including a source of fluid under pressure, fluid circuitry operatively interconnecting said fluid pressure source and said cylinder assembly and control means disposed in said circuitry.

10. An assembly according to claim 1 wherein said restricting means comprises a moveable member disposed on one of said gripping members, normally disposed in a path traversed by a portion of the other of said gripping members when said gripping members are displaced along said line of travel, and said disabling means comprises means for selectively displacing said moveable member out of said path traversed by said portion of the other of said gripper members.

11. An assembly according to claim 10 wherein said means for selectively displacing said moveable means comprises a fluid actuated cylinder assembly having a rod member connected to said moveable member.

12. An assembly according to claim 11 including a source of fluid under pressure, fluid circuitry interconnecting said pressurized fluid source and said cylinder assembly and control means disposed in said circuitry.

13. An assembly according to claim 11 wherein said moveable member comprises an arm member rigidly secured to said rod member, having an abutment surface disposed in a plane disposed perpendicular to the line of travel of said gripping members.

14. An assembly according to claim 11 wherein said moveable member is yieldingly biased into the position disposed in the path traversed by said portion of the other of said gripping members.

15. An assembly for coupling a maneuvering member to a working implement comprising:

a first coupling component mountable on said working implement;

a second coupling component mountable on said maneuvering member and cooperative with said first coupling component for selectively coupling said first coupling component to said second coupling component;

said first coupling component having an annular undercut portion providing an outwardly facing, beveled gripping surface;

said second coupling component having a fixed gripping member and a moveable gripping member displaceable relative to said fixed gripping member along a line of travel, said gripping members having arcuate undercut portions providing inwardly facing, beveled gripping surfaces engageable with said outwardly facing beveled gripping surface of said first coupling component for coupling said components together;

means for selectively displacing said moveable gripping member relative to said fixed gripping member along said line of travel into a fully coupled condition of said coupling components with said gripping surfaces firmly engaged, and into a fully uncoupled condition of said coupling components with said gripping surfaces sufficiently displaced apart to permit said second coupling component to be totally removed from said first coupling component;

latch means for restricting the displacement of said moveable gripping member relative to said fixed gripping member into a partially uncoupled condition between said fully coupled and fully uncoupled condition, insufficient to permit the removal of said second coupling component from said first coupling component yet sufficient to permit rotational displacement of said coupling components relative to each other and about an axis of said annular undercut portion; and means for selectively disabling said latch means.

16. An assembly according to claim 15 wherein said first coupling component is rigidly secured to said working implement.

17. An assembly according to claim 15 wherein said second coupling component is detachably connectable to said maneuvering member.

18. An assembly according to claim 15 wherein said means for selectively displacing said moveable gripping member to said fixed gripping member comprises at least one fluid actuating cylinder assembly operatively interconnecting said gripping members.

19. An assembly according to claim 18 including a source of fluid under pressure, fluid circuitry operatively interconnecting said fluid pressure source and said cylinder assembly and control means disposed in said circuitry.

20. An assembly according to claim 15 wherein said latch means comprises a moveable latch member disposed on said fixed gripper member normally disposed in a path traversed by a portion of said moveable gripping member when said moveable gripping member is displaced relative to said fixed gripping member along said line of travel, and said disabling means comprises means for selectively displacing said latch member out of said path traversed by a portion of said moveable gripping member.

21. An assembly according to claim 20 wherein said means for selectively displacing said latch means comprises a fluid actuated cylinder assembly having a rod member connected to said latch member.

22. An assembly according to claim 21 including a source of fluid under pressure, fluid circuitry operatively interconnecting said pressurized fluid source and said cylinder assembly and control means disposed in said fluid circuitry.

23. An assembly according to claim 21 wherein said latch member comprises an arm member rigidly secured to said rod member, having an abutment surface disposed in a plane disposed normal to the line of travel of said moveable gripping member.

24. An assembly according to claim 21 wherein said latch member is yieldably biased into the position disposed in the path traversed by said portion of said moveable gripping member.

25. An assembly according to claim 21 including means for visibly detecting when said latch means has been displaced allowing full displacement of said gripping members and detachment of said coupling components.

26. An assembly according to claim 21 wherein upon actuation of said displacing means, a portion of said rod member of said fluid actuated cylinder assembly will be caused to project exteriorly of said second coupling component to provide a visual indication of the detachability of said coupling assembly.

* * * * *